US007111685B2

(12) United States Patent
Fields

(10) Patent No.: US 7,111,685 B2
(45) Date of Patent: Sep. 26, 2006

(54) DOWNHOLE SAMPLING APPARATUS AND METHOD

(75) Inventor: Troy Fields, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 169 days.

(21) Appl. No.: 10/604,495

(22) Filed: Jul. 25, 2003

(65) Prior Publication Data

US 2005/0016727 A1 Jan. 27, 2005

(51) Int. Cl.
*E21B 43/11* (2006.01)
*E21B 49/10* (2006.01)

(52) U.S. Cl. ..... 166/298; 166/55.2; 166/100; 166/264; 73/152.25; 175/59

(58) Field of Classification Search ..... 166/100, 166/264, 298, 55.1, 55.2; 73/152.24, 152.25; 175/20, 58, 59, 312
See application file for complete search history.

(56) References Cited

U.S. PATENT DOCUMENTS 3,177,955 A * 4/1965 Sterling et al. ..... 175/21
3,430,711 A * 3/1969 Taggart ..... 175/4.52
3,730,268 A * 5/1973 Burnside ..... 166/227
3,924,463 A * 12/1975 Urbanosky ..... 73/152.25
4,287,946 A 9/1981 Brieger
4,417,622 A 11/1983 Hyde
4,495,073 A 1/1985 Beimgraben
4,505,341 A 3/1985 Moody et al.
4,745,802 A 5/1988 Purfurst
5,056,595 A 10/1991 Desbrandes
5,195,588 A 3/1993 Dave
5,327,974 A 7/1994 Donovan et al.
5,377,750 A 1/1995 Arterbury et al.
5,379,852 A 1/1995 Strange, Jr.
5,692,565 A 12/1997 MacDougall et al.
5,875,840 A 3/1999 Dietle
6,026,915 A 2/2000 Smith et al.
6,152,218 A 11/2000 Safargar
6,164,126 A * 12/2000 Ciglenec et al. ..... 73/152.01
6,276,453 B1 * 8/2001 Bond ..... 166/313
6,772,839 B1 * 8/2004 Bond ..... 166/298

* cited by examiner

*Primary Examiner*—Kenneth Thompson
(74) *Attorney, Agent, or Firm*—Matthias Abrell; Victor H. Segura; William B. Batzer

(57) ABSTRACT

A method and apparatus for reducing debris in a perforation in a wellbore extending from the wellbore into a subterranean formations is provided. A housing is positioned in the wellbore, and an arm is extended therefrom. One or more plugs are positionable in the perforation via the arm. The plug is adapted to block debris from formation fluid flowing into the housing via the perforation whereby the contamination in the formation fluid is reduced. The plug may be a filter positionable in the perforation, or a bit activated to dislodge debris.

42 Claims, 9 Drawing Sheets

FIG. 4a
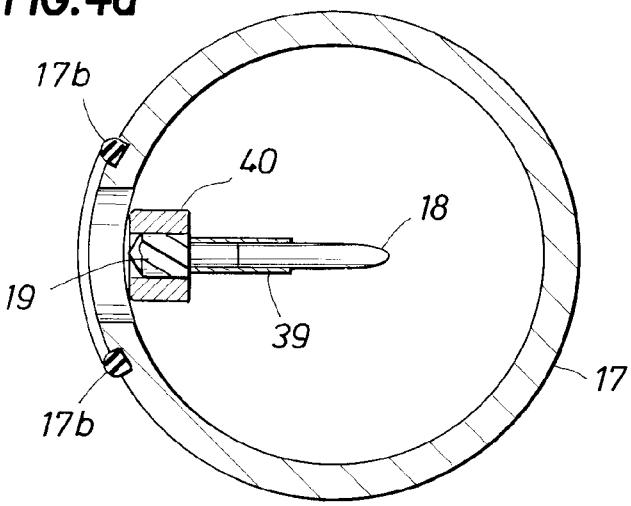
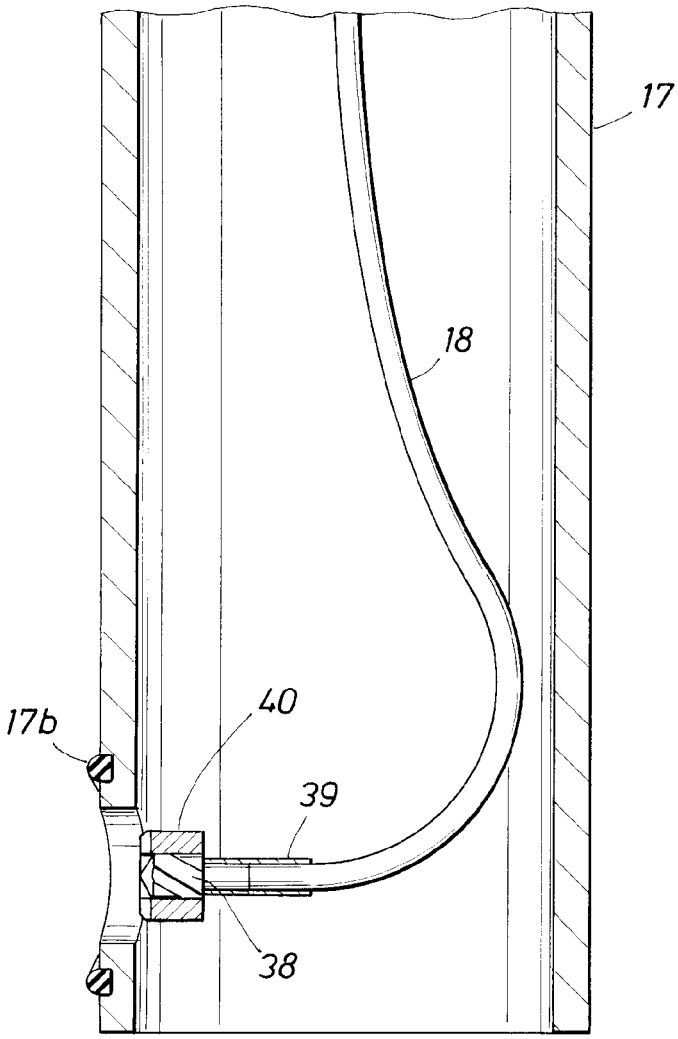
FIG. 4b
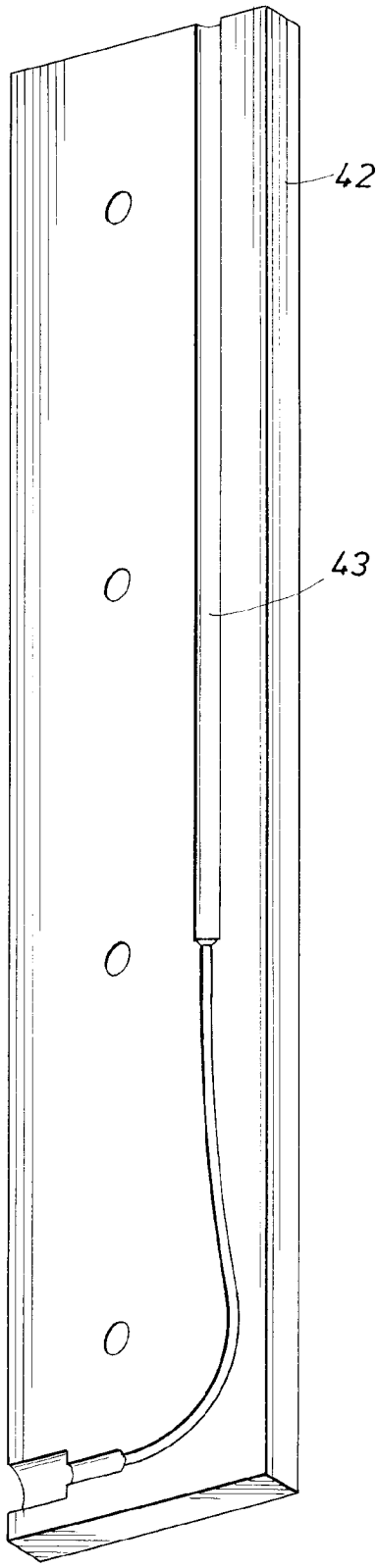
FIG. 5

DOWNHOLE SAMPLING APPARATUS AND METHOD

BACKGROUND OF INVENTION

1. Field of the Invention

This invention relates generally to the downhole investigation of subterranean formations. More particularly, this invention relates to sampling through perforations in a wellbore penetrating the subterranean formation.

2. Background Art

Historically, wells have been drilled to seek out downhole reservoirs containing highly desirable fluids, such as oil, gas or water. The wells may be located on land or over waterbeds and extend downhole into subterranean formations. In the search for oil and gas reserves, new wells are often drilled and tested. The wellbore may remain "open" after drilling, or be provided with a casing (otherwise known as a liner) to form a "cased" wellbore. A cased wellbore is created by inserting a tubular steel casing into an open wellbore and pumping cement downhole to secure the casing in place in the wellbore. The cement is employed on the outside of the casing to hold the casing in place and to provide a degree of structural integrity and a seal between the formation and the casing.

Various tests are typically performed on open wellbores to analyze surrounding formations for the presence of oil and gas. Once the casing is installed, the ability to perform tests is limited by the steel casing. It is estimated that there are approximately 200 cased wells which are considered for abandonment each year in North America, which adds to the thousands of wells that are already idle. These abandoned wells have been determined to no longer produce oil and gas in necessary quantities to be economically profitable. However, the majority of these wells were drilled in the late 1960's and 1970's and logged using techniques that are primitive by today's standards. Thus, recent research has uncovered evidence that many of these abandoned wells contain large amounts of recoverable natural gas and oil (perhaps as much as 100 to 200 trillion cubic feet) that have been missed by conventional production techniques. Because the majority of the field development costs such as drilling, casing and cementing have already been incurred for these wells, the exploitation of these wells to produce oil and natural gas resources could prove to be an inexpensive venture that would increase production of hydrocarbons and gas. It is, therefore, desirable to perform additional tests on such cased wellbores.

In order to perform various tests on a cased wellbore to determine whether the well is a good candidate for production, it is often necessary to perforate the casing to investigate the formation surrounding the wellbore. One such commercially used perforation technique employs a tool which can be lowered on a wireline to a cased section of a borehole, the tool including a shaped explosive charge for perforating the casing, and testing and sampling devices for measuring hydraulic parameters of the environment behind the casing and/or for taking samples of fluids from said environment. Perforations may also be used in open wellbores, for example, to facilitate the exploration of the surrounding formation and/or the flow of fluid from the formation into the wellbore.

Various techniques have been developed to create perforations in wellbores. For example, U.S. Pat. No. 5,195,588 issued to Dave and U.S. Pat. No. 5,692,565 issued to MacDougall et al., both assigned to the assignee of the present invention, disclose techniques for perforating a wellbore. These patents also provide techniques for plugging a wellbore after the perforation is created to stop the flow of fluid through the casing and into the wellbore.

While the advances in perforation techniques have assisted in the analysis of open and cased wellbores, it has been discovered that some perforations may become obstructed by debris. This debris may prevent the passage of fluids and/or tools through the perforation. Additionally, debris, such as drilling fluids, mud, dirt and other contaminants, may pollute the sampling or testing process and corrupt the test results.

Techniques have also been developed to prevent contamination of samples collected during the sampling process. For example, U.S. Pat. No. 4,495,073 to Beimgraben, U.S. Pat. No. 5,379,852 to Strange, Jr. and U.S. Pat. No. 5,377,750 to Arterbury each disclose filtering techniques for preventing downhole drilling fluids from contaminating samples. However, these techniques fail to address the problem of contamination and debris in the perforation.

To address problems, such as obstructions and contamination encountered with perforations, there remains a need to develop techniques to remove debris. It is desirable that such techniques reduce the contamination of fluids sampled from a perforation and/or prevent clogging of the perforation. It is also desirable that such techniques be usable in conjunction with perforating, testing, sampling and/or plugging operations. Such a technique should, among others, improve the quality of the sample, reduce the potential for debris to flow into the perforation, reduce the likelihood of clogging the perforation, reduce contamination in the sample, reduce contamination in the downhole tool and/or provide other advantages.

SUMMARY OF INVENTION

An aspect of the invention relates to a downhole tool for reducing debris in a perforation in a wellbore. The perforation extends from the wellbore into a subterranean formations. The tool includes a housing positionable in the wellbore, an arm in the housing and extendable therefrom and at least one plug in the housing. The plug is positionable in the perforation via the arm. The plug is adapted to block debris from formation fluid flowing into the housing via the perforation whereby the contamination in the formation fluid is reduced. The plug may be, for example, a bit or a filter plug.

Another aspect of the invention relates to a method for reducing debris in a perforation in a wellbore. The method includes positioning a downhole tool in the wellbore and positioning the bit in the perforation to block debris as formation fluid flows from the perforation into the housing whereby contamination is reduced in the formation fluid collected in the downhole tool. The downhole tool has a bit extendable therefrom.

Finally, in another aspect, the invention relates to a method for reducing debris in a perforation in a wellbore.

The method includes positioning a downhole tool in the wellbore, the downhole tool having at least one filter therein, and deploying the at least one filter from the downhole tool and into the perforation whereby debris is prevented from passing from the perforation into the downhole tool.

The present invention also has features and advantages that will become more readily apparent from the following detailed description when taken in conjunction with the accompanying drawings.

The various aspects of the invention may be usable in conjunction or integral with apparatuses for perforating and resealing casing in an earth borehole. Such an apparatus may have the capability to sample and test the earth formation fluids. The apparatus is moveable through the casing and can be mounted on a wireline, on tubing, or on both. Mounted inside the apparatus is a perforating means for creating a perforation through the casing and into the borehole. The plugging means is also mounted inside the device for plugging the perforation. A plurality of plugs can be stored in the apparatus to permit the plugging of several perforations during one tool run in the borehole. The apparatus will also generally include means for testing/sampling (that is, testing for hydraulic properties such as pressure or flow rate, and/or sampling fluids) of the fluids of formations behind the casing.

This apparatus may also employ perforating means comprising a flexible shaft to be used to drill a perforation through the casing and formation. The flexibility of the flexible shaft permits drilling a perforation into the formation at lengths greater than the diameter of the borehole and thereby enables the sampling at formation depths greater than the borehole diameter. Plugging means are also mounted in the device for plugging the perforation. In an embodiment of the invention, the means for plugging the perforation comprises means for inserting a plug of a solid material into the perforation.

To secure the apparatus in the borehole, a means for setting said device at a substantially fixed location may be provided. The apparatus also preferably has the capability of actuating the perforating means and the plugging means while the device is set at a substantially fixed location. Also this apparatus can have a means for moving the perforating means to a desired position in the borehole. There is also a means for moving the plugging means to a position opposite the perforation in the casing.

This apparatus may have some additional features. First, this invention uses perforating means to perforate the casing, preferably capable of creating a more uniform perforation which can be easily plugged and without the need to use of non-solid plugging means. Another advantage is the ability to extend the perforation to lengths in the formation that are greater than the diameter of the borehole. This apparatus may be implemented with a wireline device and does not require tubing, although tubing can be used if desired. Another result of this advantage is more flexibility in aligning a motor and power devices. A further advantage of a form of the present invention is that a perforation can be plugged while the tool is still set in the position at which the perforation was made, so the plugging operation can be specifically and accurately directed to the perforation, without the need for locating the perforation or for wasting the plugging medium by plugging a region that is larger than the perforation itself.

BRIEF DESCRIPTION OF DRAWINGS

FIG. 4*a* is a diametrical tool section of the flexible drilling shaft of FIG. 1.

FIG. 4*b* is a longitudinal tool section of the flexible drilling shaft of FIG. 1 positioned in a guide plate.

FIG. 5 is another view of the mating guide plate of FIG. 4*b*.

DETAILED DESCRIPTION

Illustrative embodiments of the invention are described below. In the interest of clarity, not all features of an actual implementation are described in this specification. It will of course be appreciated that in the development of any such actual embodiment, numerous implementadecisions must be made to achieve the developers" specific goals, such as compliwith system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
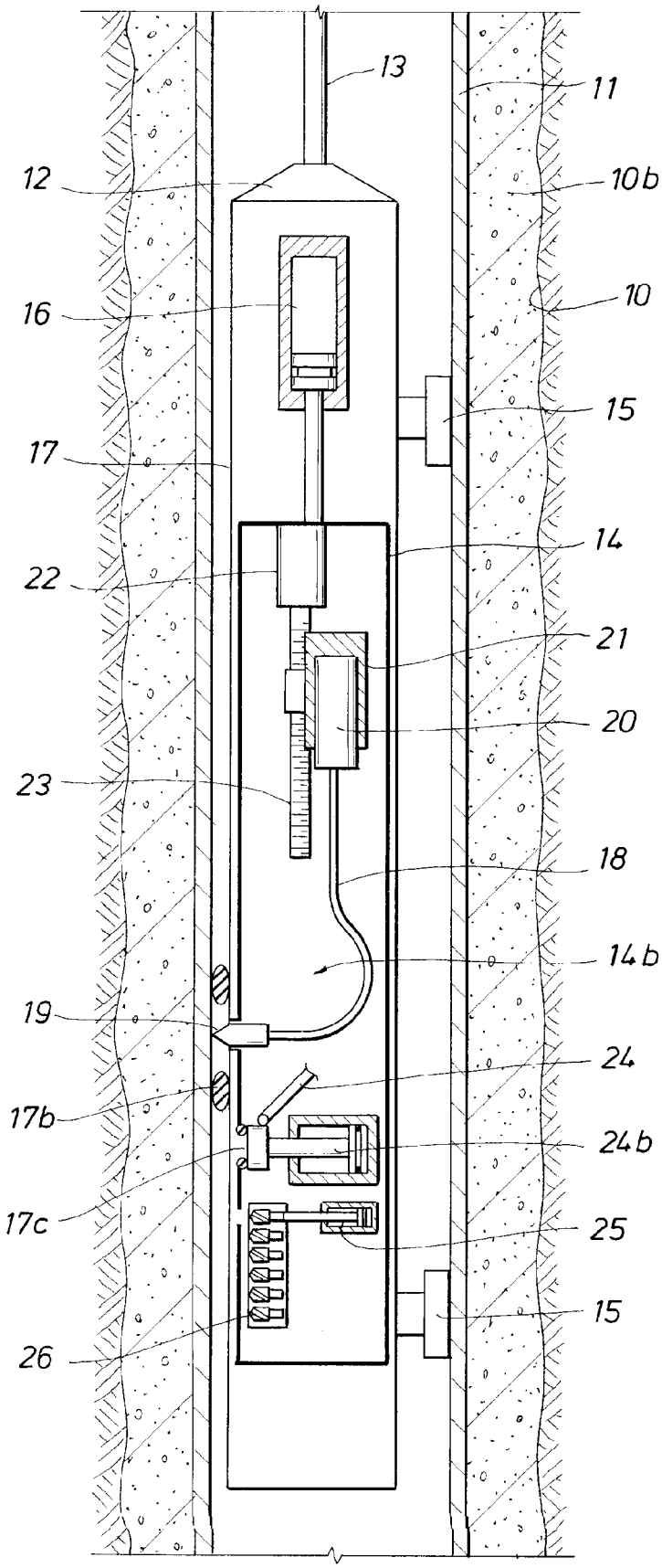
FIG. 1 is a schematic diagram of a downhole perforating tool with a flexible drilling shaft.
Figure 2:
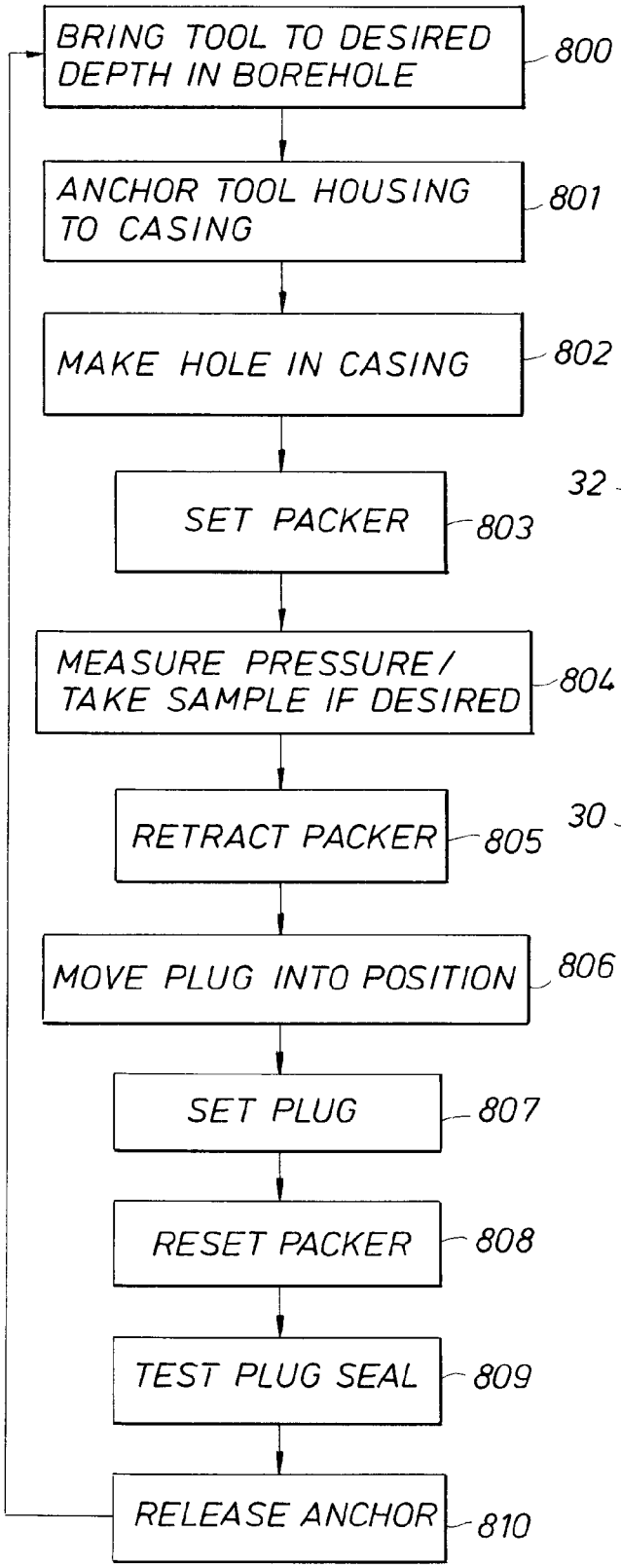
FIG. 2 is a flow diagram of a method for perforating and plugging a cased wellbore.

FIG. 1 shows an example of a downhole perforating tool usable in connection with the present invention, and FIG. 2 illustrates the flow sequence of a perforation operation. The tool 12 is suspended on a cable 13, inside steel casing 11. This steel casing sheathes the borehole 10 and is supported with cement 10*b*. The borehole 10 is typically filled with a completion fluid or water. The cable length substantially determines the depths to which the tool 12 can be lowered into the borehole. Depth gauges can determine displacement of the cable over a support mechanism (sheave wheel) and determines the particular depth of the logging tool 12. The cable length is controlled by a suitable known means at the surface such as a drum and winch mechanism (not shown). Depth may also be determined by electrical, nuclear or other sensors which correlate depth to previous measurements made in the well or to the well casing. Also, electronic circuitry (not shown) at the surface represents control communications and processing circuitry for the logging tool 12. The circuitry may be of known type and does not need to have novel features. The block 800 in FIG. 2 represents bringing the tool 12 to a specific depth level.

In the embodiment of FIG. 1, the tool 12 shown has a generally cylindrical body 17 which encloses an inner housing 14 and electronics. Anchor pistons 15 force the tool-packer 17*b* against the casing 11 forming a pressure-tight seal between the tool and the casing and serving to keep the tool stationary block 801.

The inner housing 14 contains the perforating means, testing and sampling means and the plugging means. This inner housing is moved along the tool axis (vertically) by the housing translation piston 16. This movement positions, in succession, the components of each of these three systems over the same point on the casing.

A flexible shaft 18 is located inside the inner housing and conveyed through guide plates 14*b* (also see FIG. 5) which are integral parts of this inner housing. A drill bit 19 is rotated via the flexible shaft 18 by the drive motor 20. This motor is held in the inner housing by a motor bracket 21, which is itself attached to a translation motor 22. The translation motor moves the inner housing by turning a threaded shaft 23 inside a mating nut in the motor bracket 21. The flex shaft translation motor provides a downward force on the flex shaft during drilling, thus controlling the penetration. This drilling system allows holes to be drilled which are substantially deeper than the tool diameter. This drilling operation is shown in block 802.

Figure 3:
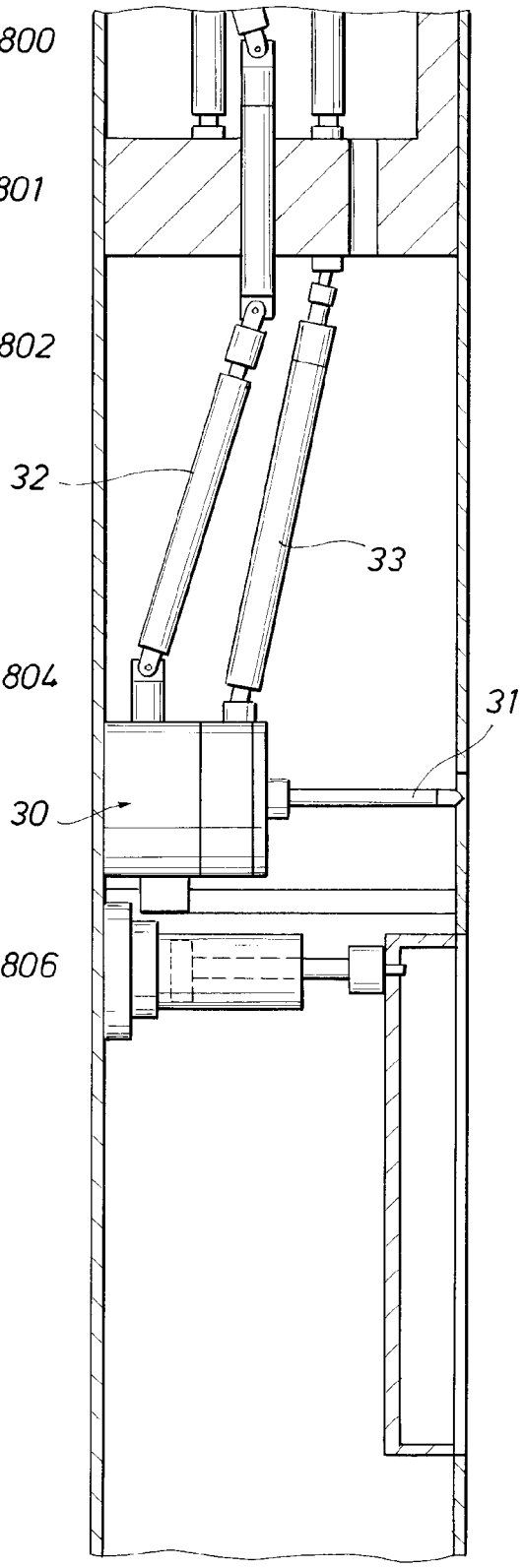
FIG.3 (PRIOR ART)
FIG. 3 a view of a conventional drill bit system for creating a perforation and plugging the perforation.

Technology does exist that can produce perforations of a depth somewhat less than the diameter of the tool. One of these methods is shown in FIG. 3. In this approach the drill bit 31 is fitted directly to a right-angle gearbox 30, both of which are packaged perpendicular to the axis of the tool body. As shown, the gearbox 30 and drill bit 31 must fit inside the borehole. In this FIG. 2, the length of a drill bit is limited because the gearbox occupies approximately one-half the diameter of the borehole. This system also contains a drive shaft 32 and a flowline 33.

For the purpose of taking measurements and samples, a measurement-packer 17*c* and flow line 24 are also contained in the inner housing. After a hole has been drilled, the housing translation piston 16 shifts the inner housing 14 to move the measurement-packer into position over the drilled hole. The measurement packer setting piston 24*b* then pushes the measurement packer 17*c* against the casing thereby forming a sealed conduit between the drilled hole and flowline 24 as shown in block 803. The formation pressure can then be measured and a fluid sample acquired, if that is desired 804. At this point, the measurement-packer is retracted 805.

Finally, a plug magazine 26 is also contained in the inner housing 14. After formation pressure has been measured and samples taken, the housing translation piston 16 shifts the inner housing 14 to move the plug magazine 26 into position over the drilled hole 806. A plug setting piston 25 then forces one plug from the magazine into the casing, thus resealing the drilled hole 807. The integrity of the plug seal may be tested by once again moving the inner housing so as to re-position the measurement-packer over the plug, then actuating this packer hole 808 and monitoring pressure through the flowline while a "drawdown" piston is actuated dropping and remaining constant at this reduced value. A plug leak will be indicated by a return of the pressure to the flowline pressure found after actuating the drawdown piston. It should be noted that this same testing method (809) can be used to verify the integrity of the tool-packer seal before drilling commences. However, for this test the measurement-packer is not set against the casing, thus allowing the drawdown to be supported by the tool-packer. The sequence of events is completed by releasing the tool anchors 810. The tool is then ready to repeat the sequence starting with block 800.

Flexible Shaft

The flexible drilling shaft is shown in detail in FIGS. 4*a* and 4*b* and one of the pair of flexshaft guide plates is shown detailed in FIG. 5. In FIG. 4*a*, a diametrical tool cross-section view, shows the flexshaft and drill bit in the tool body 17. The drill bit 19 is connected to the flexshaft 18 by a coupling 39. The coupling can be swaged onto the flex shaft. Guide bushings 40 enclose and hold the drill bit to keep the drill bit straight and in place. FIG. 4*b* is a longitudinal tool section that shows the advantage of a flexshaft over conventional technology. FIG. 5 shows one of the two mating guide plates 42 which form the "J" shaped conduit 43 through which flexshaft is conveyed.

The flexshaft is a well known machine element for conveying torque around a bend. It is generally constructed by helically winding, in opposite directions, successive layers of wire over a straight central mandrel wire. The flex shaft properties are tailored to the specific application by varying the number of wires in each layer, the number of layers, the wire diameter and the wire material. In this particular application the shaft must be optimized for fatigue life (number of revolutions), minimum bend radius (to allow packaging in the given tool diameter) and for conveying thrust.

Another concern is the shaft reliability when applying thrust to the drill bit through the shaft. During drilling operations various amounts of thrust are applied to the drill bit to facilitate drilling. The amount of thrust applied depends on the sharpness of the bit and the material being drilled. Sharper bits only require the application of minimum thrust through the flexible shaft. This minimum thrust has virtually no affect on the reliability of the flexible shaft. Duller bits require the application of more thrust that could damage the flexible shaft. One solution is to apply the thrust directly to the drill bit instead of through the flexible shaft. In this method, force applied to a piston located in the tool is transferred by the piston to the drill bit. The thrust necessary for drilling is supplied without any effect on the flexible shaft. This technique is further described in a U.S. Pat. No. 5,687,806. A second solution is to use a sharp bit each time a drilling operation occurs. Multiple bits can be stored in the tool and a new bit used for each drilling procedure. As previously stated, the amount of thrust required by sharper bits has minimal affect on the flexible shaft. This technique is further described in a U.S. Pat. No. 5,746,279.

Guideplates

When the flexshaft is used to convey both torque and thrust, as it is in this application, some means must be provided to support the shaft to prevent it from buckling from the thrust loading applied through the flexshaft to the drill bit. This support is provided by the mating pair of guide plates FIG. 5. These plates form the "J" shaped conduit through which the flexshaft passes. Forming this geometry from a pair of plates is a practical means of fabrication and an aid in assembly, but is not strictly necessary for functionality. A "J" shaped tube could serve the same function. The inner diameter formed from the pair of plates is only slightly larger than the diameter of the flexshaft. This close fit minimizes the helical windup of the flexshaft in high torque drilling situations and it also maximizes the efficiency with which torque can be conveyed from the drive to the drill bit. The guideplate material is chosen for compatibility with the flexshaft. A lubricant can be used between the flexshaft and the guide-plates.

Drillbit

The drillbit used in this invention requires several traits. It must be tough enough to drill steel without fracturing the sharp cutting edge. It must be simultaneously hard enough to drill abrasive formations without undo dulling.

It must have a tip geometry giving torque and thrust characteristics which match the capabilities of the flexible drive shaft. It must have a fluting capable of moving drill cuttings out of a hole many drill-diameters deep. The drill must be capable of drilling a hole sufficiently straight, round and not oversized so that the metal plug can seal it.

Plugging Mechanism

Figure 6A:
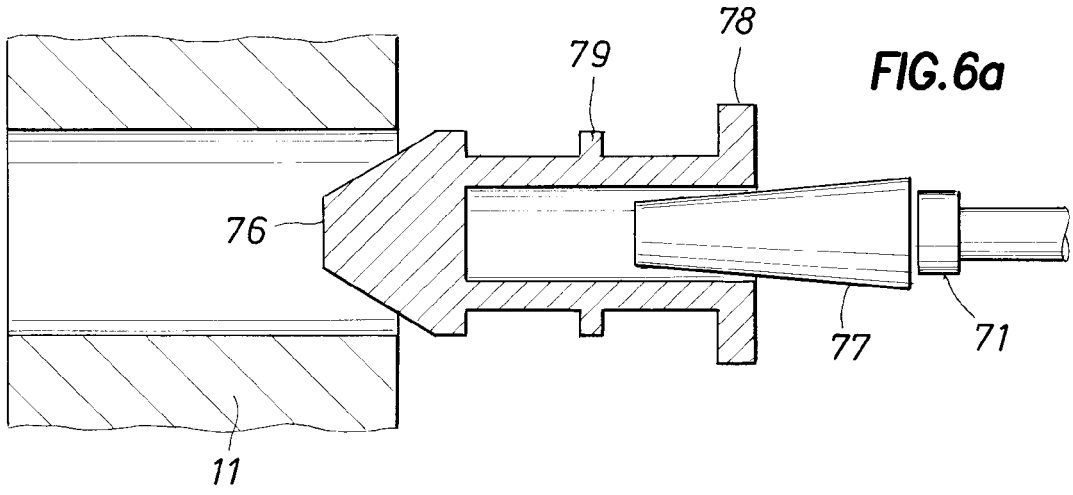
FIG. 6*a* is side view of the components of a plugging assembly.
Figure 6B:
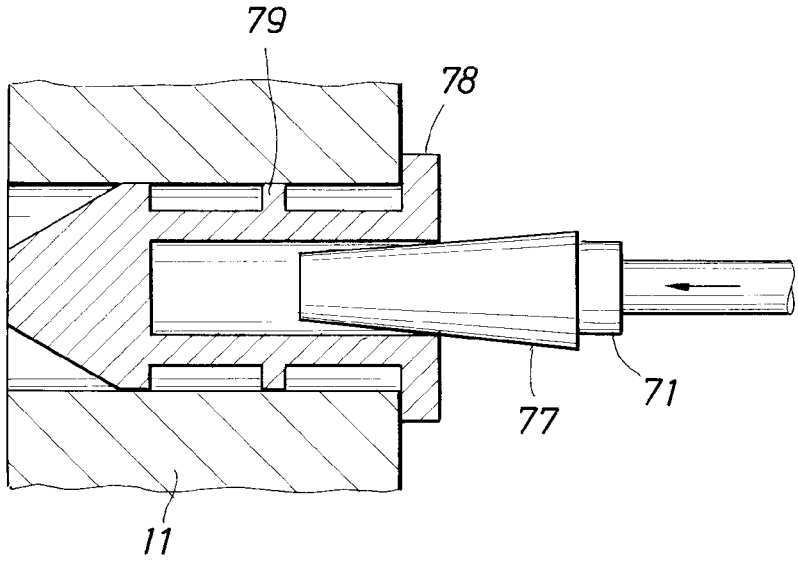
FIG. 6*b* is side view of the components of a plugging assembly during the plugging operation.
Figure 6C:
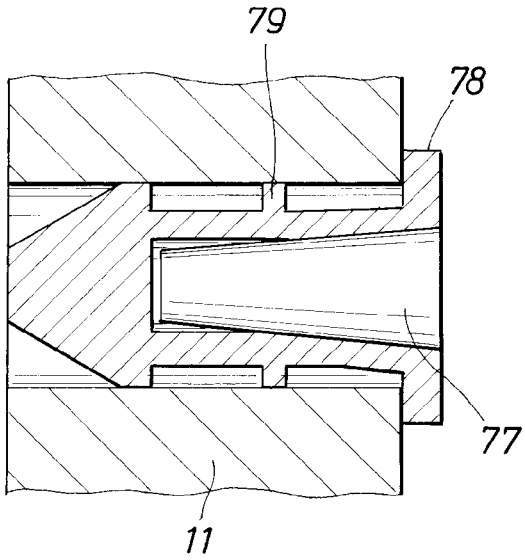
FIG. 6*c* is a side view of a plugging assembly positioned in a hole in the casing.

The plugging mechanism is shown in FIGS. 6*a*, 6*b* and 6*c*. This plugging technique has a similar plugging concept to that of U.S. Pat. No. 5,195,588, however, the plug is different. The plug is composed of two components: a tubular socket 76 and a tapered plug 77. The tubular socket 76 has a closed front end, a lip 78 at its rear and grooves 79 in its center. The tapered plug 77 is inserted in the opened end of the socket component 76. The lip 78 serves to hold the socket and prevent it from going past the casing wall when force is applied to the tapered plug component while it is inserted into the socket.

Setting the plug is a two stage process. As the piston moves forward the socket component 76 is forced into the socket component as shown in FIG. 6*c*. The tapered nature of component 77, forces the socket 76 to radially expand thus creating a tight seal between the socket and casing surface. The grooves 79 also help form a seal, and prevent the plug from blowing out. The presence of more than one groove permits the socket to more readily conform to the periphery of an irregular perforation in the casing 11 while still ensuring a good seal.

Figure 7:
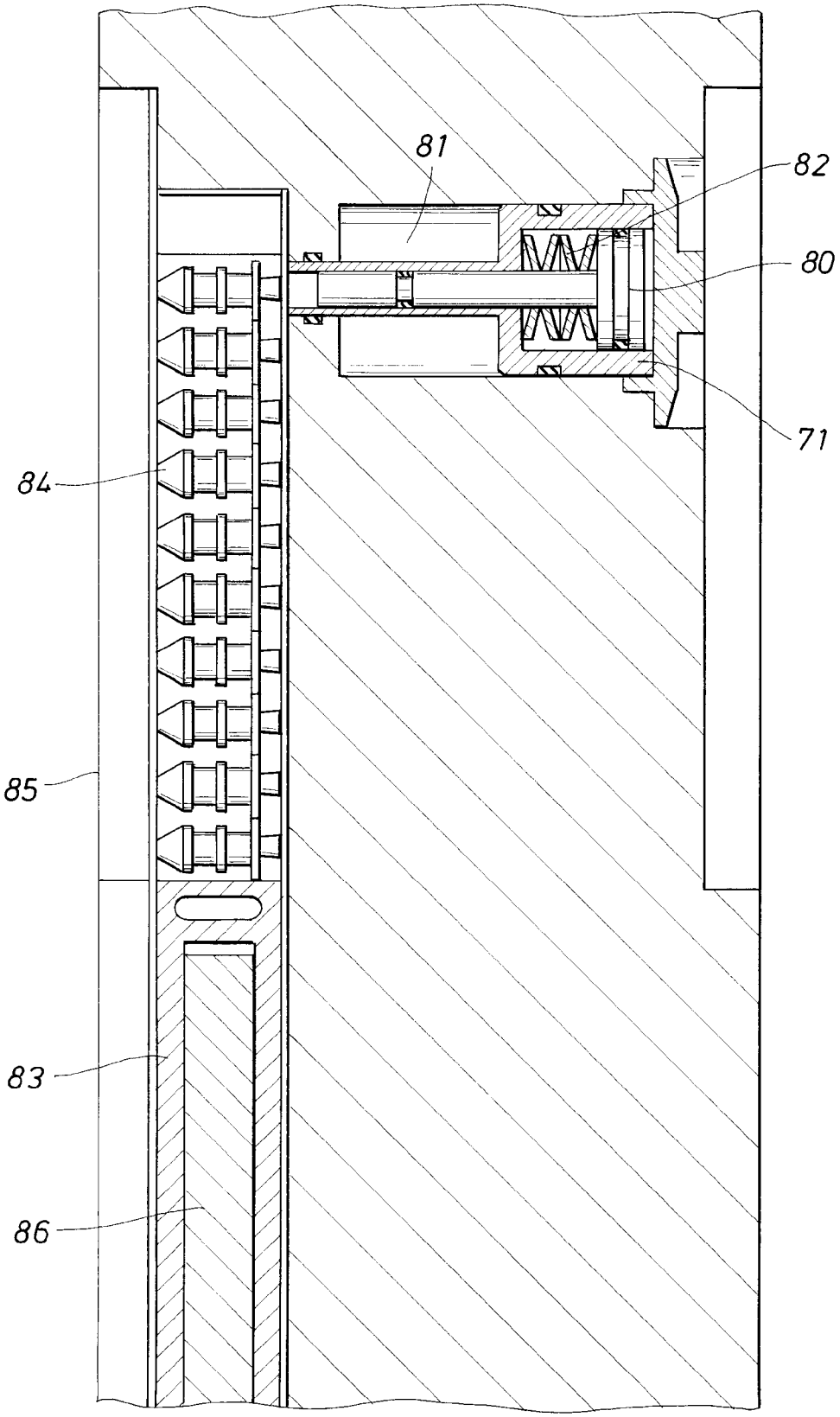
FIG. 7 is a side view of the mechanical plugger and plug magazine.

FIG. 7 shows the mechanical plugger that inserts a plug into a perforation. The plugger contains a two stage setting piston (outer piston 71 and inner piston 80). During the plugging process, as force is applied to both pistons, 71 and 80, the entire piston assembly moves a distance through space 81 forcing the plug assembly 76 and 77 into the perforation. When the lip portion 78 of the socket component 76 reaches the casing, the movement of the outer piston 71 stops. The continued application of hydraulic pressure upon the piston assembly causes the inner piston to overcome the force of the springs 82. Thus, the inner piston 80 continues to move forcing the tapered plug 77 into the socket 76.

FIG. 7 also shows the magazine 85 that stores multiple plugs 84 and feeds them during the plugging process. After a plug is inserted into a perforation, and the piston assembly 71 and 80 is fully retracted, another plug is forced upward and into position to be inserted into the next perforation that is to be plugged. This upward move is induced by the force from the pusher assembly 83. This force can be generated by a spring 86 or fluid.

Figure 8:
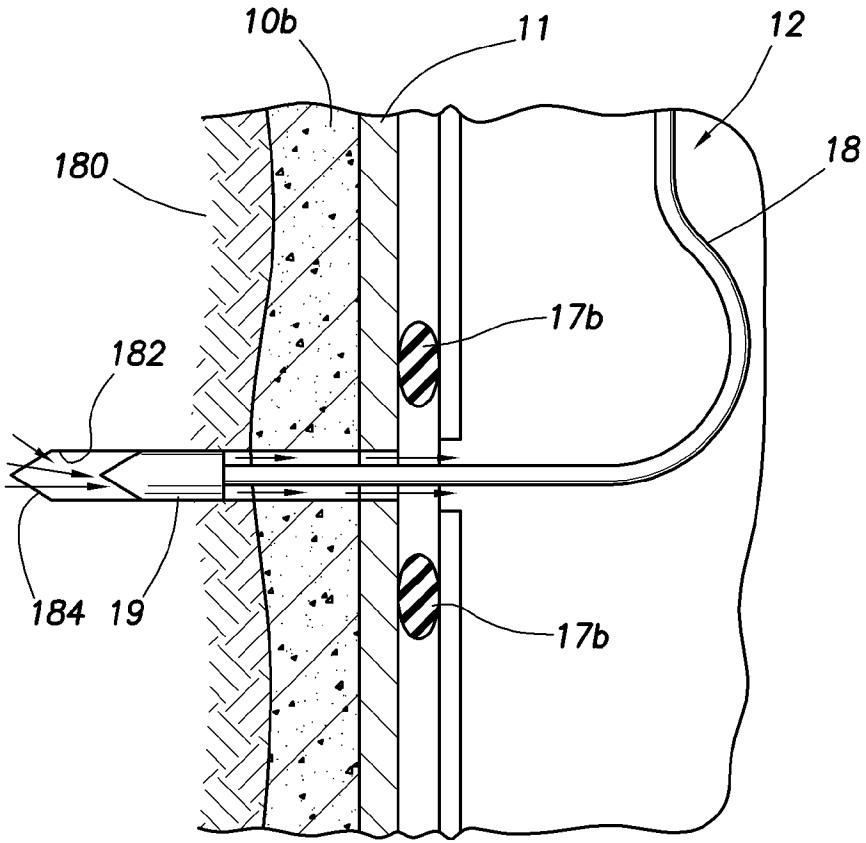
FIG. 8 is a schematic view of the apparatus of FIG. 1 perforating a cased wellbore.

Referring now to FIG. 8, the downhole tool 12 of FIG. 1 is shown perforating a cased wellbore in greater detail. The downhole tool 12 is sealingly engaged to the casing 11 via packer 17*b*. The flexible shaft 18 with drill bit 19 thereon is extended through the casing 11, the cement 10*b* and into the subterranean formation 180. A perforation 182 is created through the casing, cement and formation by the drill bit. As represented by the arrows, fluid flows from the formation 180 through perforation 182 and into the downhole tool 12. Seals 17*b* isolate the formation fluid from fluids in the wellbore.

The bit 19 is positioned in a perforation 182 created by the downhole tool 12. The bit 19 is retracted a distance from the end 184 of the perforation 182 upon completion of creation of the perforation. As indicated by the arrows, the bit is positioned in the perforation to permit fluid to flow into the downhole tool 12. The drill bit 19 is preferably positioned within the perforation during the testing and/or sampling process to restrict the flow of debris into the downhole tool 12 via the perforation. By remaining within the perforation during the testing process, the drill bit is used to restrict the flow of debris into the perforation. For convenience, the term "testing" as used herein will encompass a variety of downhole testing and/or sampling operations, such as formation sampling, pressure testing, etc.

While the bit is shown in FIG. 8 as being positioned in the formation, the drill bit may be positioned at various locations in the perforation to control the flow of fluid and/or to restrict the flow of debris into the borehole. As shown in FIG. 8, the bit is positioned beyond the casing and cement and into the formation.

Figure 9:
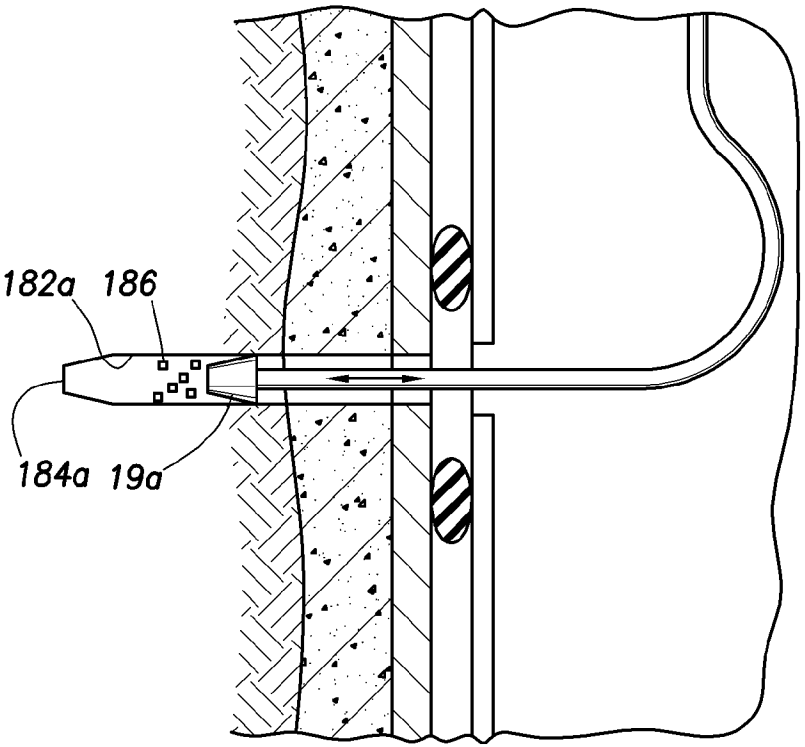
FIG. 9 is a cross-sectional view of the apparatus of FIG. 8 having a frusto-conical bit.

FIG. 9 shows an alternate embodiment of the apparatus having a bit 19*a*. In this embodiment, the bit 19*a* is activated to dislodge debris 186 in a perforation 182*a* (having an end 184*a*) to allow fluid to flow therethrough. Debris 186 (depicted diagrammatically as blocks) may collect in the perforation and block the flow of fluid from the formation into the downhole tool 12.

As depicted by arrows, to drill bit 19*a* may optionally be advanced, withdrawn and/or rotated via flexible shaft 18 to dislodge debris and/or facilitate the flow of fluid through the perforation 182*a*. The advancement and/or retraction of the drill bit 19*a* by flexible shaft 18 maybe repeated as necessary. The rotation of the drill bit 19*a* may also be repeated as necessary. This operation allows the perforation to be recreated as necessary to assure the flow of fluid through the perforation and into the downhole tool.

The operations described in FIGS. 8 and 9 may be performed during the drilling, sampling and/or testing operations Such operations may be performed after the perforation and before plugging. Alternatively, the tool may be lowered into the wellbore with existing perforations (possibly clogged perforations) and to clear out the perforations and assure fluid flow. The bit may also be released into the perforation to support the perforation, or to operate as a plug to prevent the flow of fluid into the formation.

While FIGS. 8 and 9 depict a perforation tool, such as the tool of FIGS. 1, 2 and 4–7, it will be appreciated that other perforating tools, such as the perforating tool of FIG. 3, may also be used in connection with this invention. In such an application, the bit 31 may be positioned within the perforation and/or activated to clear debris as necessary.

Figure 10:
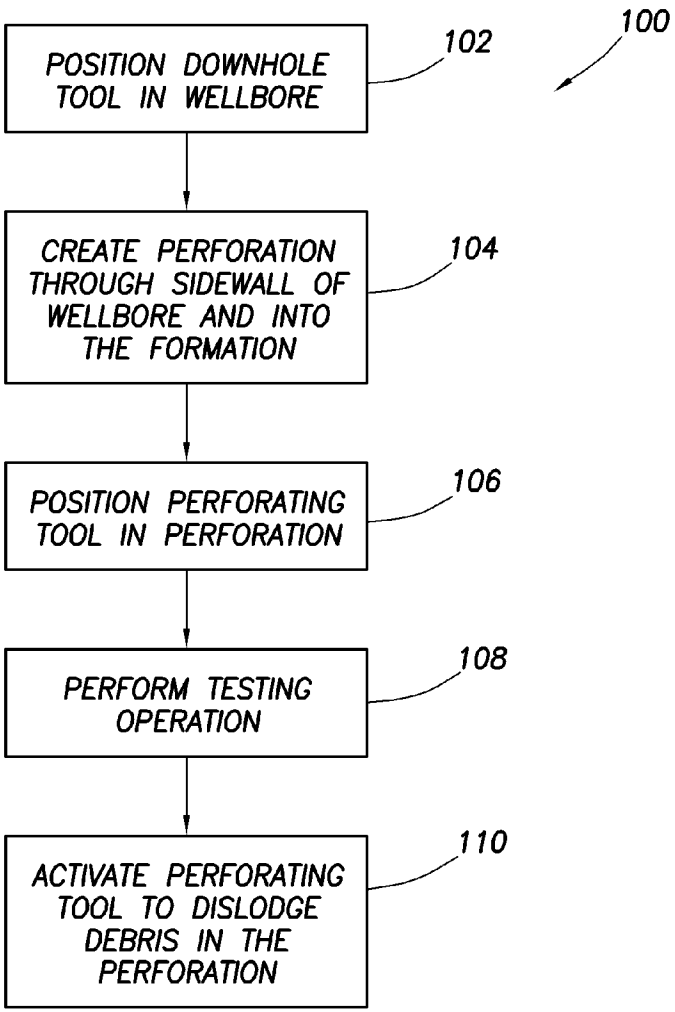
FIG. 10 is a flow chart depicting a method of reducing contamination in a perforation.

Referring now to FIG. 10, a method depicting the operation of the apparatus of FIGS. 8 and 9 is depicted. FIG. 10 describes a method 100 of dislodging debris from the perforation. The method 100 includes the steps of positioning the downhole tool in the wellbore 102 and creating a perforation through the sidewall of the wellbore and into the formation 104. The perforation may be made in a cased or open hole wellbore and extend the desired distance into the formation, such as a distance greater than the diameter of the wellbore. Any known perforation technique may be used for creating the perforation including, but not limited to, drilling, punching, shape charging or other known techniques.

A perforating tool may then be positioned in the perforation 106. The perforating tool may be the same tool that created the original perforation, or another type of perforating tool capable of clearing debris from the perforation. By way of example, a downhole tool, such as the drilling tool of FIGS. 8 and/or 9 may be employed. The perforating tool may remain in the perforation after completion of creation of the perforation, or be inserted into an existing perforation after removal of the perforating tool. The perforating tool may be positioned at any given position in the perforation to provide the desired result and, optionally, be repositioned within the perforation as desired.

A testing operation 108 may be performed before or after positioning the perforating tool in the perforation. Typically, the perforating tool is positioned in the perforation when the perforation is created and then retracted to the desired position within the perforation to allow fluid to flow into the downhole tool. However, the perforating tool may be positioned in the perforation after the perforation has been created. Thus, sampling may have occurred before the perforating tool is positioned in the perforation.

Testing 108 may be performed by allowing fluid to flow from the perforation and into the downhole tool. At this time, samples of formation fluid may be taken and/or pressures read. Samples may be drawn into sample chambers or other portions of the tool (not shown) for downhole or uphole testing. A variety of testing known by those of skill in the art is envisioned.

Should conditions suggest problems with the perforation, the downhole tool may activate the perforation tool to dislodge the debris 110. The downhole tool may activate the perforation tool by advancing, retracting and/or rotating the perforation tool to dislodge debris. This may be continued as necessary to remove any clogs and/or facilitate the flow of fluid through the perforation.

The downhole tool may activate the perforating tool based on sensor readings, downhole measurements, at regular intervals or based on other criteria. The perforating tool and/or plug may be provided with sensors for detecting debris in the perforation. A processor may be used to collect and/or analyze data to determine when to activate the perforating tool. Alternatively, the downhole tool may be activated at will to perform such a clearing operation.

Figure 11:
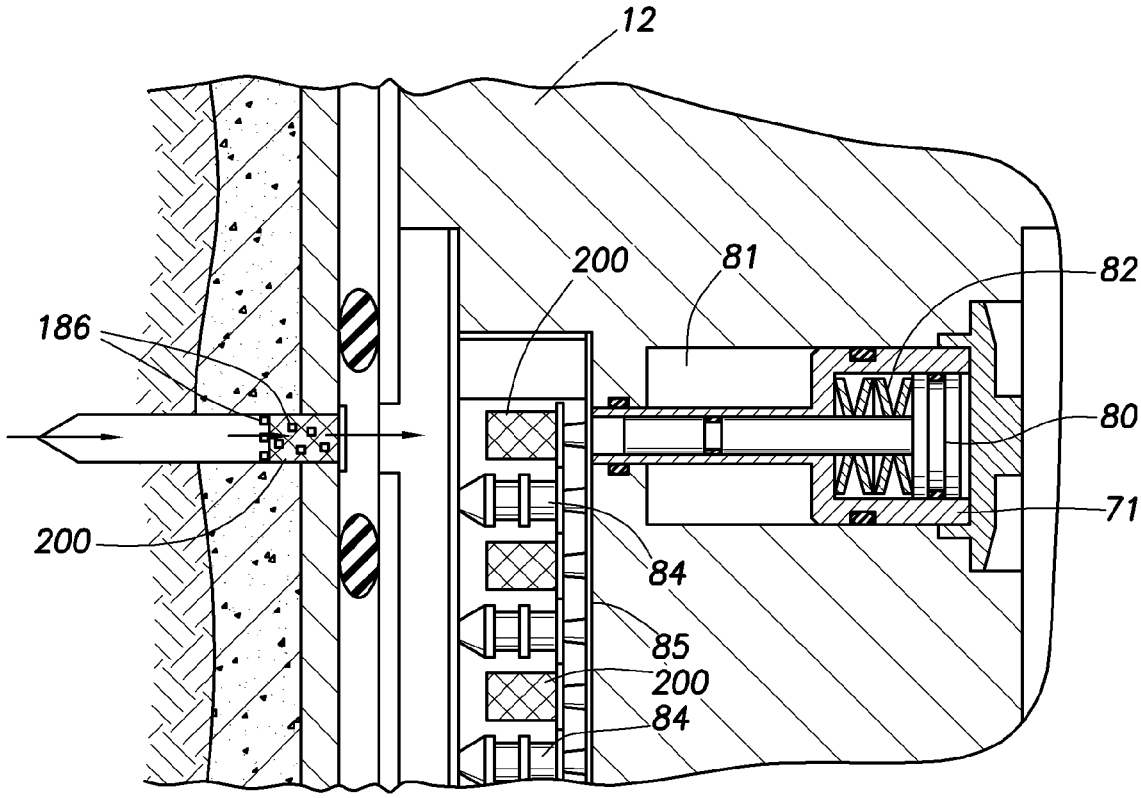
FIG. 11 is a cross-sectional view of the apparatus of FIG. 1 inserting a filter plug into a perforation of a cased wellbore.

FIG. 11 shows the plugging mechanism, or plugger, of FIGS. 1 and 7 employing a filter plug 200. The plugger operates as previously described with respect to FIGS. 1 and 7, except that the magazine contains one or more filter plugs 200. The magazine 85 may be used to store one or more plugs 84 (FIG. 7) and/or filter plugs 200 for insertion into the sidewall of the wellbore.

With continuing reference to FIG. 11, a filter plug 200 is positionable in the perforation 182 to filter contaminates or debris, such as drilling mud, dirt, cement, or other contaminants. The debris is graphically depicted as blocks 186 for simplicity. The filter plug 200 is preferably positioned in the perforation after a perforating tool, such as the drilling tool 18 of FIG. 1, creates a perforation.

The filter plug may be positioned at various locations along the perforation, such as at the casing, at the cement, in the formation, and at the end of the perforation against the formation. Part or all of the filter plug is provided with a mesh capable of permitting fluid to flow through the filter plug and into the downhole tool while preventing solid contaminants from passing therethrough. As depicted by the arrows, formation fluid flows into the perforation, through the filter plug and into the downhole tool.

If desired, the filter plug may be removed or left in the perforation. Should the filter plug become clogged, stuck or otherwise undesirable, it is possible to drill through the filter plug thereby eliminating the need to remove the filter plug from the perforation. In other words, the perforating tool re-perforates the hole with the filter plug therein and creates a perforation through the filter plug as well. In this manner, the perforation may be restored by merely perforating through the existing filter plug. Additional filter plugs may then be inserted to replace and/or supplement the original filter plug if desired.

Figure 12A:
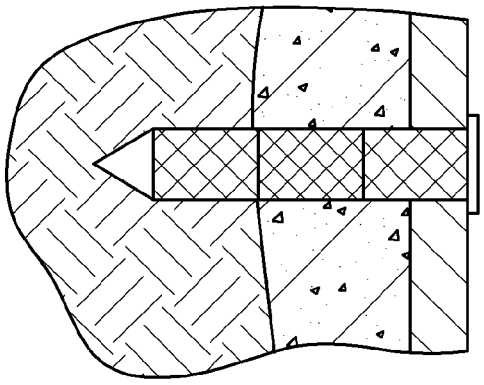
FIGS. 12A and 12B are cross-sectional views of a perforation with a plurality of filter plugs positioned therein.
Figure 12B:
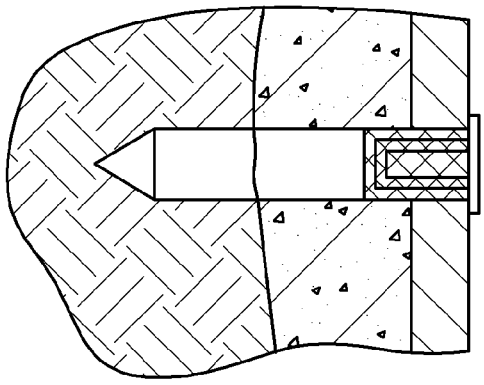

As shown in FIGS. 12A and 12B, one or more filter plugs 200 may be positioned in a perforation. The filter plugs may be stacked linearly along a perforation as shown in FIG. 12A, or stacked concentrically in one position of the perforation as shown in FIG. 12B. Similar sized filter plugs and/or filter plugs with stops or closed ends may be used to stack the filter as desired. Different diameter filter plugs may be used so that the filter plugs may be stacked concentrically. Additionally, the filter plugs may also be provided with a hole at one end to receive an additional filter plug. By stacking filter plugs concentrically, the filter plugs may be layered to increase the filtering effect. One or more filter plugs may be used to filter all or part of the perforation. The filter plugs may be inserted one at a time, or in groups.

Figure 13A:
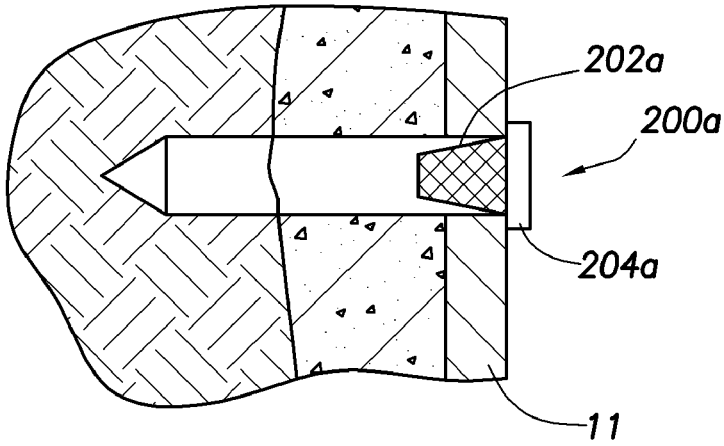
FIGS. 13A–13C are detailed views of various filter plugs.
Figure 13B:
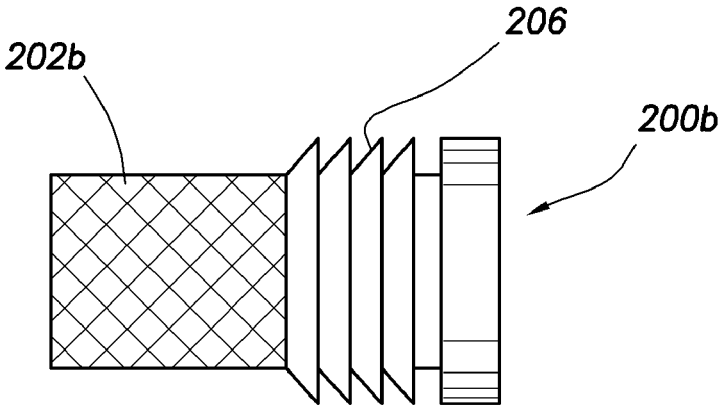
Figure 13C:
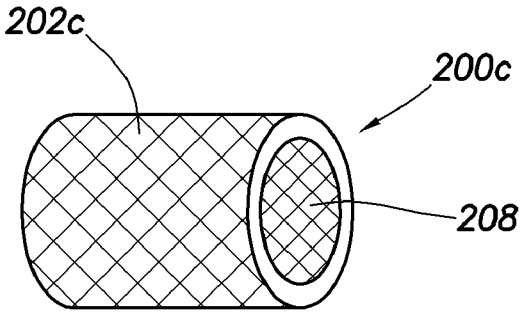

Referring now to FIGS. 13A–C, embodiments of the filter plug are shown in greater detail. Preferably, the filter plug 200 has generally cylindrical body with an internal cavity therein. The body is preferably made of metal and has a mesh and/or gravel pack body having a pore size adapted to allow fluid to pass therethrough while prevent solids from passing therethrough. Preferably, the filter plug is provided with a body adapted to be penetrated by a drilling tool to perforate therethrough as previously described with respect to FIG. 11.

As shown in FIG. 13A, the filter plug 200*a* may have a tapered body 202*a* to facilitate advancement into the perforation and/or prevent retraction therefrom. The filter plug 200*a* may also be provided with a lip portion 204*a* having a diameter larger than the body portion 202*a* of the filter plug to act as a mechanical stop preventing the filter plug from advancing further into the perforation. In embodiments with a lip, the filter plug is intended to extend through the casing 11. However, the lip stops the filter plug from advancing and maintains the filter plug adjacent the casing 11.

The filter plug may also be provided with a device for resisting movement as shown in FIG. 13B. The device, in this case anchor grooves 206 disposed about the body 202*b*, assists in conforming the filter plug to the perforation and securing it therein. This may also be used to prevent the filter plug from withdrawing from the perforation. Other techniques may be used to secure the filter plug in the perforation. For example, the shape of the filter plug can be adapted for an interference-fit with the casing perforation upon insertion therein.

As shown in FIG. 13C, the filter plug 200*c* may have an open end 208 at one end thereof. The open end may be adapted to receive an additional filter plug, a perforating tool and/or merely allow fluid to flow more easily therethrough. In this embodiment, the filter plug has a cylindrical body 202*c* without anchor grooves or a mechanical stop. However, such features may optionally be included.

While the filter plug is preferably depicted as being generally cylindrical (FIGS. 13B and 13C) to conform to the general shape of the perforation, or frusto-conical (FIG. 13A) to advance into the perforation, it will be appreciated that the filter plug may be of any dimension or geometry capable of restricting debris in the perforation. One or more lips, materials, layers, or meshes may be used as part of the filter plug. Additionally, the filter plug may extend from the perforation into the borehole, if desired. The filter plug may be made longer or shorter, to fill a desired portion (or all) of the perforation. Additionally, the body may be of a soft metal that deforms as it advances into the hole to engage the perforation and conform thereto.

Figure 14:
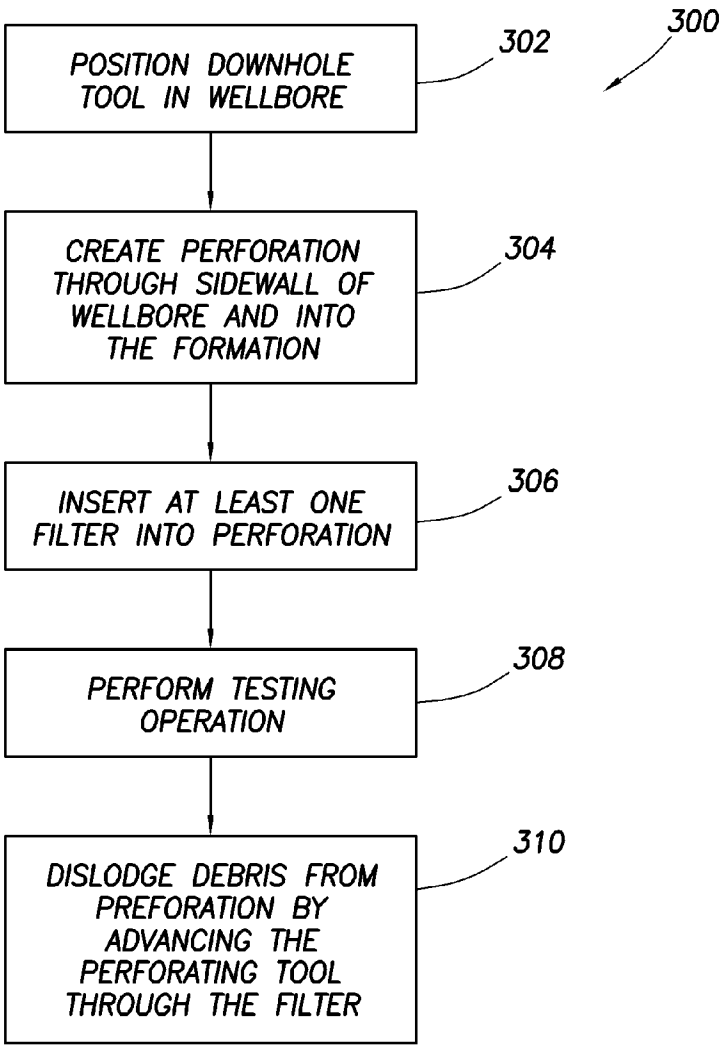
FIG. 14 is a flow chart depicting an alternate embodiment of a method of reducing contamination in a perforation.

Referring now to FIG. 14, a method 300 depicting the operation of the apparatus of FIG. 11 is depicted. The method 300 describes a method for reducing contamination of fluid in a perforation. This method 300 includes positioning a downhole tool in the wellbore 302 and creating a perforation through the sidewall of the wellbore and into the formation 304. The method 300 further comprises inserting at least one filter plug into the perforation 306. The filter plug may be inserted by the perforating or plugging tool and positioned at a desirable location within the perforation.

The filter plug is preferably inserted into the perforation prior to performing a testing operation 308. The testing operation 308 is performed substantially as described with respect to step 108 of FIG. 10. The filter plug is capable of preventing contaminants and other debris from entering the downhole tool with the formation fluid as it flows from the formation, through the filter plug and into the downhole tool. Step 306 may be repeated to insert additional and/or multiple filter plugs. The sampling operation may be done before, between or after insertion of one or more filter plugs.

If it becomes desirable to clear the penetration and remove the filter plug, the perforating tool may be inserted through the filter plug to dislodge or clear debris from the perforation by advancing the perforating tool through the filter and/or any debris 310. Step 306 may then be repeated to insert additional filter plugs, if desired, so that additional testing 308 may be performed. Once testing is complete, the perforation may be plugged. The downhole tool may be repositioned to perform another operation, or retrieved uphole.

The method and apparatuses described herein provide various advantages over the prior art. These methods and apparatuses have been described in connection with the preferred embodiments without limited thereto. For example, while the methods and apparatuses described herein are depicted as being used in connection with the techniques disclosed in U.S. Pat. No. 5,692,565, it will be appreciated by one skilled in the art that the methods and apparatuses may be used in connection with other downhole tools capable of performing perforating and/or plugging operations. For example, the filter plug of FIGS. 11–13 may be installed before or after the drilling tool performs the perforation technique of FIG. 10. The methods may be used consecutively to facilitate testing. Various perforating and/or plugging tools may be used in conjunction with these techniques. Other changes, variations and modifications to the basic design may be made without departing from the inventive concept.

In addition, these changes, variations modifications would be obvious to those skilled in the art having the benefit of the foregoing teachings contained in this application. All such changes, variations and modifications are intended to be within the scope of the invention which is limited by the following claims.

The invention claimed is:

1. A downhole tool for reducing debris in a perforation in a wellbore, the perforation extending from the wellbore into a subterranean formation, the tool comprising:

a housing positionable in the wellbore; and an arm in the housing and extendable therefrom, wherein the arm comprises a flexible shaft; and at least one debris blocker in the housing, the at least one debris blocker positionable in the perforation via the arm and releasable therein such that when released and positioned in the perforation, the at least one debris blocker prevents debris from flowing through the perforation and into the housing with a formation fluid whereby the contamination in the formation fluid is reduced.

2. The downhole tool of claim 1 wherein the downhole tool further comprises a perforator adapted to create the perforation.

3. The downhole tool of claim 2 wherein the perforator is a punching tool.

4. The downhole tool of claim 2 wherein the perforator is a drilling tool.

5. The downhole tool of claim 2 wherein the perforator has a bit positionable in the perforation and operable between a stationary and an activated mode, wherein in the stationary mode the bit permits the flow of fluid past the outer surface of the bit while preventing the flow of debris, and wherein in the activated mode the bit is movable to dislodging debris in the perforation.

6. The downhole tool of claim 5 wherein in the activated mode the bit is movable by one of rotation, advancement, refraction and combinations thereof.

7. The downhole tool of claim 2 wherein the at least one debris blocker is at least one filter.

8. The downhole tool of claim 7 wherein the perforator is capable of creating a perforation through the filter.

9. The downhole tool of claim 1 wherein the at least one debris blocker comprises at least one plug for sealing the perforation.

10. The downhole tool of claim 1 wherein the at least one debris blocker comprises at least one filter.

11. The downhole tool of claim 10 wherein the at least one filter comprises a plurality of filters stacked concentrically in the perforation.

12. The downhole tool of claim 10 wherein the at least one filter comprises a plurality of filters stacked linearly in the perforation.

13. The downhole tool of claim 10 wherein the at least one filter has a body, at least a portion of the body comprising mesh.

14. The downhole tool of claim 13 wherein the at least one filter has a lip, the lip having a diameter greater than the diameter of the body.

15. The downhole tool of claim 13 wherein the body is cylindrical.

16. The downhole tool of claim 13 wherein the body is frusto-conical.

17. The downhole tool of claim 1, wherein the wellbore is an openhole wellbore.

18. The downhole tool of claim 1, wherein the wellbore is a cased wellbore.

19. The downhole tool of claim 1, further comprising a seal capable of sealing the housing about the perforation to isolate the formation fluid from contaminants in the wellbore.

20. The downhole tool of claim 1 wherein the at least one debris blocker comprises a bit and wherein the bit is adapted to create the perforation.

21. The downhole tool of claim 20 wherein the bit is positionable in the perforation and operable between a stationary and an activated mode, wherein in the stationary mode the bit permits the flow of fluid past the outer surface of the bit while preventing the flow of debris, and wherein in the activated mode the bit is movable to dislodging debris in the perforation.

22. The downhole tool of claim 1 further comprising a magazine for storing the at least one debris blocker within the housing.

23. A method for reducing debris in a perforation in a wellbore, the perforation extending front the wellbore into a subterranean formation, comprising:

positioning a downhole tool in the wellbore, the downhole tool having a bit extendable therefrom;

using a flexible shaft to position and release the bit in the perforation to block debris as formation fluid flaws from the perforation into the downhole tool whereby contamination is reduced in the formation fluid collected in the downhole tool.

24. The method of claim 23 further comprising creating a perforation in the sidewall of the wellbore.

25. The method of claim 23 further comprising detecting debris in the perforation.

26. The method of claim 23 further comprising activating the bit to dislodge debris from the perforation.

27. The method of claim 26 wherein the step of activating comprises one of rotating the bit, advancing the bit, retracting the bit, and combinations thereof.

28. The method of claim 23 further comprising plugging the perforation.

29. The method of claim 23 further comprising positioning at least one filter in the perforation.

30. The method of claim 29 further comprising advancing the bit through the filter.

31. The method of claim 29 further comprising stacking filters in the perforation.

32. The method of claim 31 wherein the filters are stacked concentrically.

33. The method of claim 31 wherein the filters are stacked linearly.

34. The method of claim 23 wherein the wellbore is a cased wellbore.

35. The method of claim 23 wherein the wellbore is an open wellbore.

36. The method of claim 23 further comprising sampling formation fluid via the perforation.

37. The method of claim 23 further comprising testing the formation via the perforation.

38. A method for reducing debris in a perforation in a wellbore, the perforation extending from the wellbore into a subterranean formations, comprising:

positioning a downhole tool in the wellbore, the downhole tool having an arm extendable therefrom;

using a flexible shaft to position and release at least one debris blocker in the perforation via the arm, the debris blocker-preventing debris from flowing into the downhole tool as formation fluid flows through the perforation into the downhole tool.

39. The method of claim 38 wherein the at least one debris blocker comprises a bit adapted to selectively move within the perforation to clear debris.

40. The method of claim 38 wherein the at least one debris blocker comprises at least one filter positionable in the perforation.

41. The method of claim 38 further comprising testing the formation fluid.

42. The method of claim 38 further comprising collecting samples of the formation fluid.

* * * * *